US005657419A

United States Patent [19]

Yoo et al.

[11] Patent Number: 5,657,419

[45] Date of Patent: Aug. 12, 1997

[54] METHOD FOR PROCESSING SPEECH SIGNAL IN SPEECH PROCESSING SYSTEM

[75] Inventors: Hah-Young Yoo; Kyung-Jin Byun; Ki-Chun Han; Jong-Jae Kim, all of Daejeon; Myung-Jin Bae, Seoul, all of Rep. of Korea

[73] Assignee: Electronics and Telecommunications Research Institute, Daejeon, Rep. of Korea

[21] Appl. No.: 352,831

[22] Filed: Dec. 2, 1994

[30] Foreign Application Priority Data

Dec. 20, 1993 [KR] Rep. of Korea ..... 93-28673

[51] Int. Cl.[6] ..... G10L 9/00

[52] U.S. Cl. ..... 395/2.32; 395/2.31; 395/2.3

[58] Field of Search ..... 395/2.32, 2.33, 395/2.26, 2.45, 2.16, 2.28, 2.46; 381/29–31, 33–45

[56] References Cited

U.S. PATENT DOCUMENTS

| | | | |
|---|---|---|---|
| 4,731,846 | 3/1988 | Secrest et al. | 381/49 |
| 4,932,061 | 6/1990 | Kroon et al. | 381/30 |
| 5,097,508 | 3/1992 | Valenzuela Steude et al. | 381/36 |
| 5,127,053 | 6/1992 | Koch | 381/31 |
| 5,138,661 | 8/1992 | Zinser et al. | 381/35 |
| 5,173,941 | 12/1992 | Yip et al. | 381/36 |
| 5,179,594 | 1/1993 | Yip et al. | 381/40 |
| 5,199,076 | 3/1993 | Taniguchi et al. | 381/36 |
| 5,245,662 | 9/1993 | Taniguchi et al. | 381/36 |
| 5,265,190 | 11/1993 | Yip et al. | 395/2.28 |
| 5,339,384 | 8/1994 | Chen | 395/2.2 |
| 5,371,853 | 12/1994 | Kao et al. | 395/2.32 |

OTHER PUBLICATIONS

Kroon et al., ("Strategies for improving the performance of CELP coders at low bit rates", ICASSP '88: Acoustics, Speech & Signal Processing Conference, pp. 151–154) Sep. 1988.

Dimolitsas, ("Coding of speech at 16 Kbit/s using low–delay Code Excited Linear Prediction (LD–CELP", CCITT study group XV, Geneva, 11–22 Nov. 1991, pp. 1–21) Nov. 1991.

*Primary Examiner*—Allen R. MacDonald
*Assistant Examiner*—Vijay B. Chawan
*Attorney, Agent, or Firm*—Larson and Taylor

[57] ABSTRACT

A method for processing an input speech signal to be applied to a CELP vocoder has the steps of obtaining preliminary pitch search intervals by a preprocessing autocorrelation expression from a pitch lag of a synthesized speech signal which is synthesized from a residual signal of the input speech signal; computing coefficients of pitch filter with respect to the preliminary pitches; searching a high interval in the autocorrelation; and removing the remaining interval other than the high interval in the pitch lag. Since the present invention proposes a speech processing method which uses only a high interval in autocorrelation of a voice waveform in pitch-searching, and where such a speech processing method is embodied in a CELP vocoder, total computation time of the CELP vocoder can be decreased 37% or more without lowering speech quality. Therefore, a digital signal processor, which is low in price and is slow in speed, can be embodied in a CELP vocoder.

2 Claims, 3 Drawing Sheets

METHOD FOR PROCESSING SPEECH SIGNAL IN SPEECH PROCESSING SYSTEM

BACKGROUND OF THE INVENTION

1. Field of the Invention

The present invention relates to a method of processing a speech signal in a speech processing system, and more particularly to a method for searching a pitch period of speech signals by using an autocorrelation of CELP (code excited linear prediction) voice corder which is embodied in a speech processing system, so as to reduce the pitch period searching time.

2. Description of the Prior Art

In a digital, portable communication system, to utilize a bandwidth of a transmission channel efficiently and to obtain a high tonal quality, several vocoder (voice coder) theories are applied. Such vocoder implementation requires a large amount of computation, and particularly a pitch searching that takes more than about 50% of the overall computation necessary for a usual vocoder implementation.

Vocoder techniques can be broadly classified into the following three types: a waveform coding method; a source coding method; and a hybrid coding method. In consideration of the quality of a synthesized speech and a recent coding technique, the hybrid coding method is regarded as the most desirable.

The hybrid coding method has the memory efficiency of source coding and the naturalness and intelligibility of waveform coding. In the hybrid method, the formant information is coded generally by the linear predictive coding (LPC) method. Depending on the hybrid coding method of the residual signal of the LPC analysis, they can be classified as RELP (residual excited linear prediction), VELP (voice excited linear prediction), CELP (code excited linear prediction) and the like. Among these methods, the CELP is the most popular and has been adopted for mobile communications.

In a vocoder using the CELP method, several parameters are extracted from an input speech signal and used to analyze the speech signal.

In the CELP vocoder the manner of analysis and synthesis is used as the method for calculating codebook parameters and coefficients of pitch filter. This results in making many computations because the approach is to set the combination of possible values for the various parameters and then select that combination of parameter values that produces a synthesized speech that is most similar to the original speech. Therefore, an improvement in the computation of the pitch filter coefficients is needed to improve the operation of a CELP vocoder.

In the speech signal, if an interval of a pitch synthesis is increased to a specific range and beyond the quality of the synthesized speech is rapidly lowered. For this reason, the interval of pitch synthesis must be kept in the range of approximately 5 to 10 ms to minimize the amount of computation and prevent the quality of the synthesized speech from being degraded.

Additionally, in a speech signal sampled in 8 KHz, a closed loop structure excellent for speech quality is used to obtain pitch lag [L] and pitch gain [b] as parameters of a pitch filter. In this closed loop structure, however, the pitch lag [L] is limited in the range of from 20 to 147. Respective synthesized speech is produced with respect to 128 pitch lag values, and then a square error of the difference between the synthesized speech and the original speech is obtained.

Then, values of the pitch lag and pitch gain which generate the least error value are selected as the pitch parameters.

Generally, a CELP vocoder is broadly divided into two portions, an encoding portion and a decoding portion. A speech signal is sampled at a rate of 8000 samples/sec to produce a sampled signal as an input signal to the CELP vocoder. The sample signal to the vocoder is processed in groups of 160 samples, each group corresponding to a 20 ms frame.

In a CELP vocoder, ten LPC (linear predictive coding) coefficients, indicating formant components of the speech signal, can be obtained from the sampled signal of one frame and converted into an LSP frequency. Then, pitch searching and codebook searching are performed so as to obtain optimal pitch and codebook parameters. The pitch searching is performed once with respect to a speech signal of 5 ms so as to prevent the quality of the synthesized signal from being lowered. Therefore, the pitch searching is repeated four times per 20 ms frame.

Also, in the pitch searching process, the synthesized speech signals are compared with the original speech signal to produce optimal pitch lag and pitch gain, as described above.

FIG. 3 shows the procedure of pitch searching as a prior art speech signal processing method.

In FIG. 3, a reference signal s(n) represents an input speech signal, and is subtracted by a ZIR (zero input response) of a formant synthesizing filter 1/A(z) obtained from step 202. Suppose that the resultant value is e(n) and a signal which passes through a perceptual weighting filter W(z) is X(n). In step 204, the value e(n) is given by the equation, $$e(n)=s(n)-a_{zir}(n). \tag{1}$$

Also, the weighting and format filters are respectively expressed in equations (2) and (3) as follows:

$$W(z)=\frac{A(z)}{A(Z/\alpha)}\ ; \tag{2}$$

and $$A(z)=1-\sum_{i=1}^{10} a_i z^{-1} \tag{3}$$

where $\alpha$ is the weighting factor (usually equal to 0.8); and $a_i$ is an LPC coefficient.

On the other hand, a residual component of the input speech signal in the present frame and an output of a pitch filter in the prior frame pass through a synthesis filter H(z) in step 206, and thereby a synthesized speech signal $Y_L(n)$ can be obtained in step 210. The synthesis filter H(z) is expressed as follows:

$$H(z)=\frac{1}{A(z)}\times W(z)=\frac{1}{A(z/\alpha)} \tag{4}$$

where $\alpha$=0.8.

Also, the synthesized speech signal $y_L(n)$ is obtained by the convolution of h(n) and $P_L(n)$ in step 210, and can be expressed by the following equation:

$$y_L(n)=h(n)*p_L(n)=\sum_{i=0}^{\min(nN_h-1)} h(i)\,p_L(n-i) \tag{5}$$

where $20<L<147$, $0\leqq n<L_p$; and where h(n) is an impulse response of H(z).

From the synthesized speech signal $y_L(n)$ and the original speech signal x(n) obtained thus, a square error of the difference between them can be given by the following equation:

$$\sum_{n=0}^{L_p-1} [x(n) - b*y_L(n)]^2 \tag{6}$$

where b is a pitch gain.

The process of finding the minimum value of the above expression is equivalent to the minimum value of the search procedure of the following expression:

$$-2bE_{xyL} + b^2E_{yyL} \tag{7}$$

where $$E_{xyL} = \sum_{n=0}^{L_p-1} x(n)*y_L(n) \tag{8}$$

and $$E_{yyL} = \sum_{n=0}^{L_p-1} y_L^2(n) \tag{9}$$

As shown in FIG. 3, a lot of computation is required for searching only one pitch parameter since the repetitive computation (from step 210 to step 216) is performed 128 times in the closed loop in order to obtain the values satisfying optimal pitch gain and pitch lag.

SUMMARY OF THE INVENTION

It is an object of the present invention to provide a method for processing a speech signal in a speech processing system in which preliminary pitch search intervals are obtained by preprocessing the autocorrelation and then coefficients of the pitch filter are obtained only by searching about the preliminary pitch search intervals thus obtained.

According to an aspect of the present invention, a method for processing an input speech signal to be applied to a CELP vocoder is disclosed. The method comprises the steps of: obtaining preliminary pitch search intervals by means of a preprocessing autocorrelation expression from a pitch lag of a synthesized speech signal which is synthesized from a residual signal of the input speech signal; computing coefficients of pitch filter with respect to the preliminary pitch intervals; searching a high interval in the autocorrelation; and removing the remaining interval other than the high interval in the pitch lag.

In this method, the preprocessing correlation is defined by the following expression:

$$R(L) = \sum_{k=-1}^{1} s(n-L) \times [s(n) + s(n-2L)] + \sum_{k=-1}^{1} s(k-L) \times [s(k) + s(k-2L)] \tag{10}$$

where L=20, 21, . . . , 147;

s(n) indicates a peak of residual signal;

s(k) indicates a valley of the residual signal;

n=0 indicates vertex of the peak; and k=0 indicates vertex of the valley.

In this method, the coefficient of the pitch filter is defined as follows:

$$b_i = \frac{E_{sy}}{E_{yy}} \tag{11}$$

$$= \frac{\sum_{n=0}^{M-1} [s(n) \times s(n-L_i)]}{\sum_{n=0}^{M-1} [s(n-L_i) \times s(n-L_i)]} \tag{12}$$

Since the present invention provides a speech processing method which uses only a high interval in autocorrelation of a voice waveform in pitch-searching, when such a speech processing method is embodied in a CELP vocoder, the total computation time of the CELP vocoder can be decreased 37% and more without lowering the speech quality.

Therefore a digital signal processor, which is low in price and is slow in speed, can be used to implement a CELP vocoder.

BRIEF DESCRIPTION OF THE DRAWINGS

This invention may be better understood and its objects will become apparent to those skilled in the art by reference to the accompanying drawings as follows.

DESCRIPTION OF THE PREFERRED EMBODIMENT(S)

Figure 1:
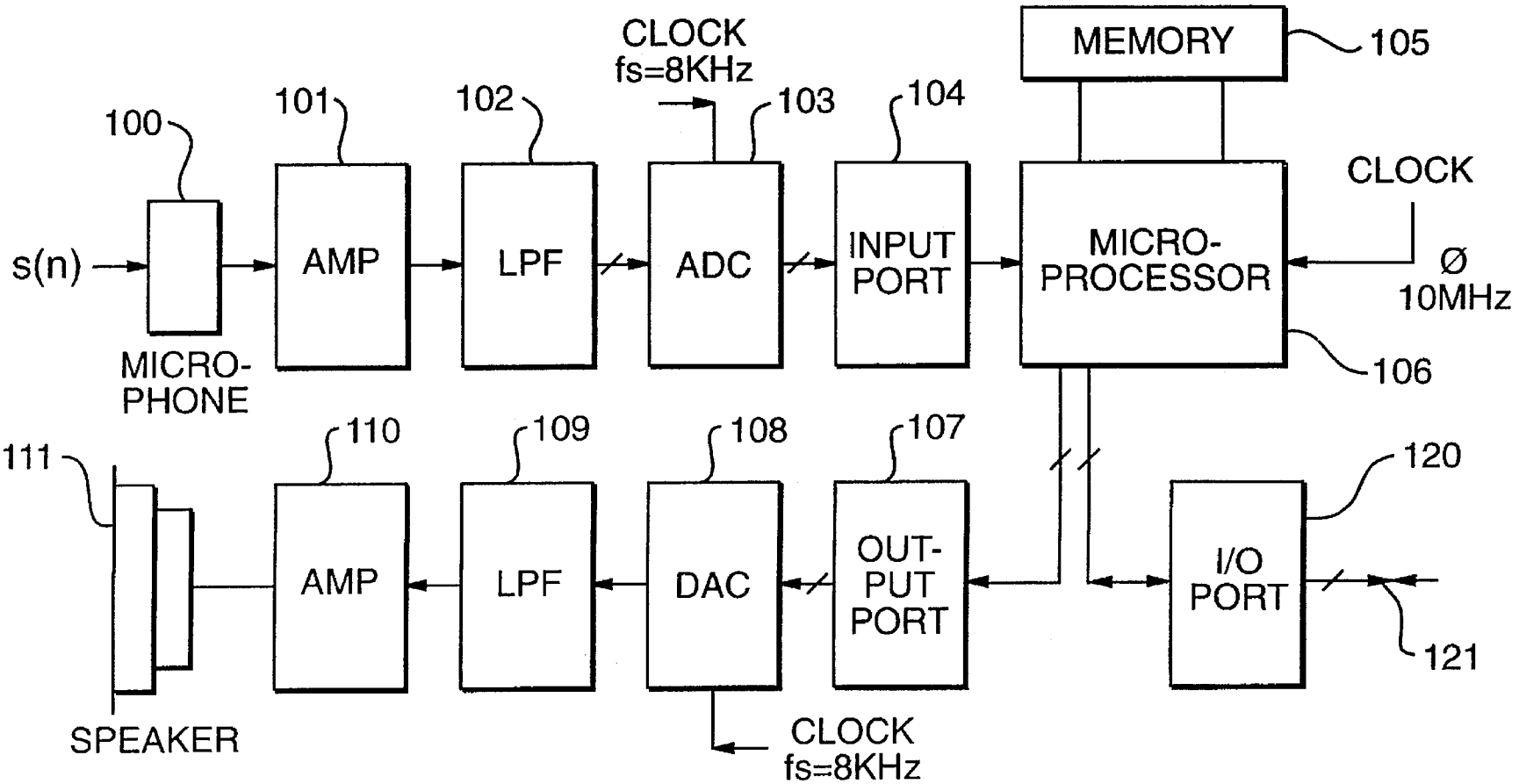
FIG. 1 is a circuit schematic block diagram showing the construction of a speech processing system in which the processing method of the present invention is embodied.

Referring to FIG. 1, a sound wave of a speech signal s(n) is converted into an electrical signal by means of a microphone 100, and the electrical signal is amplified by an amplifier 101. The electrical signal is in the frequency range from 20 Hz to 20 KHz. In this invention, since only information necessary for transmitting deliberation is required to realize the present invention, a frequency exceeding that of the information must be eliminated. For example, a frequency component of 4 KHz and more contained in the electrical signal is filtered out by a low pass filter 102.

In order to reduce the amount of data to be processed when converting the electrical signal into digital data, it is necessary to eliminate a specified frequency component in the electrical signal as described above. This conversion of the electrical signal to digital data is performed in an analog-to-digital converter 103 (hereinafter, referred to as "A/D converter"). The sampling rate is 8 KHz in accordance with a Nyquist sampling theorem and has twice the maximum frequency (i.e. 4 KHz) of the electrical signal.

To quantize the voltage level per one sample, the A/D converter 103 is composed of a 12-bit A/D converter capable of using a telephone quality as a reference quality.

The digital speech signal converted thus is provided to a microprocessor 106 through an input port 104. In microprocessor 106, the digital speech signal is processed in accordance with the procedure depicted in FIG. 2. The processed speech information is stored in a memory 105 or is transmitted to a transmission channel 121 through an input/output port 120.

On the other hand, the speech information read out in memory 105 or the speech data applied from transmission channel 121 is decoded in microprocessor 106 to be converted into a synthesized speech signal. The synthesized speech signal is supplied to a digital-to-analog converter 108 (hereinafter, referred to a "D/A converter) through an output port 107. The signal converted to an analog speech signal by D/A converter 108 is filtered by a second low pass filter 109 and then amplified in a second amplifier 110. The amplified synthesized speech signal is converted into an audible signal by a speaker 11.

Figure 2:
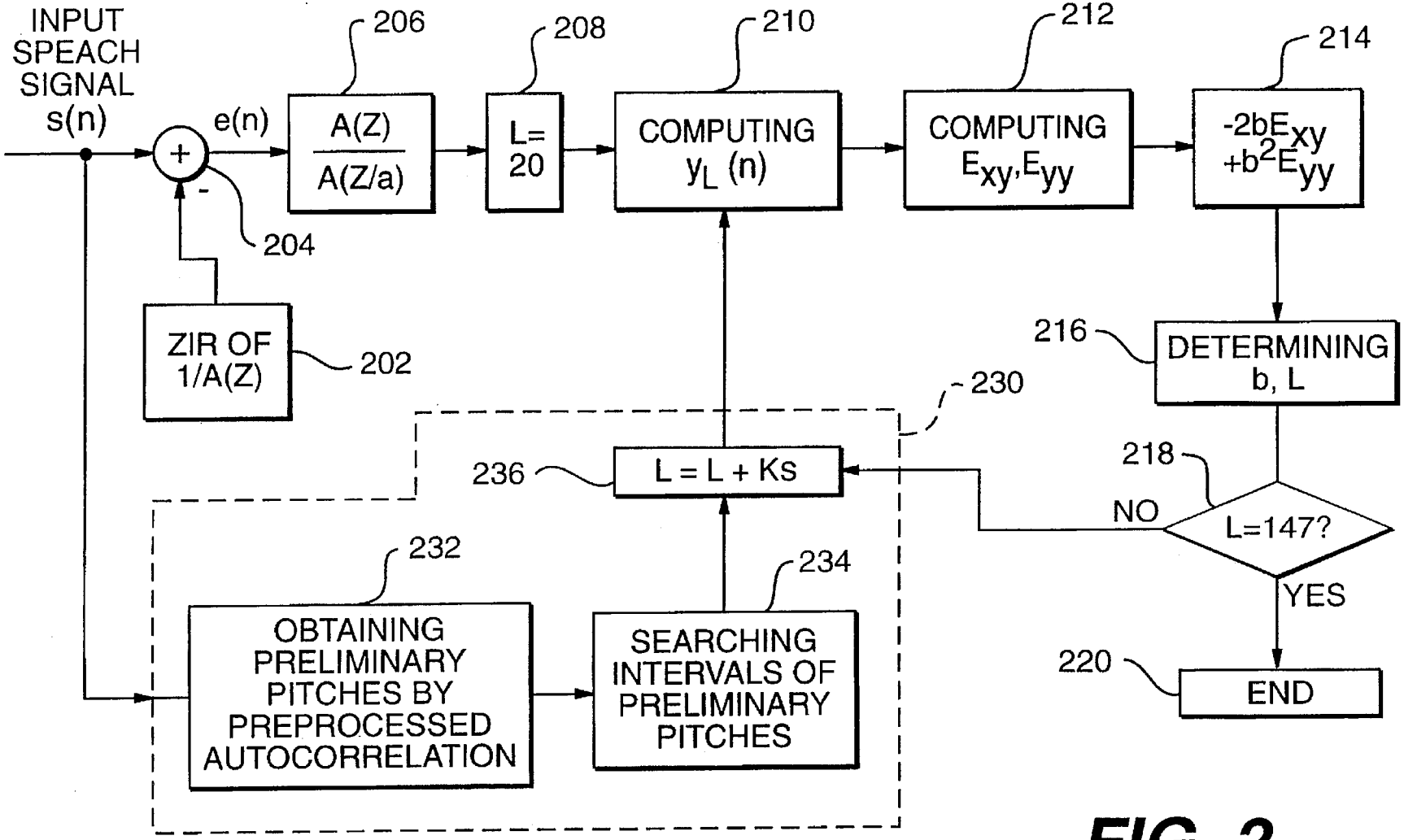
FIG. 2 is a flow-chart showing the procedure of the processing method of a speech signal according to the present invention.

FIG. 2 shows the procedure for pitch searching in the method processing a speech signal according to the present invention. The pitch searching is performed by microprocessor 106 of FIG. 1.

Figure 3:
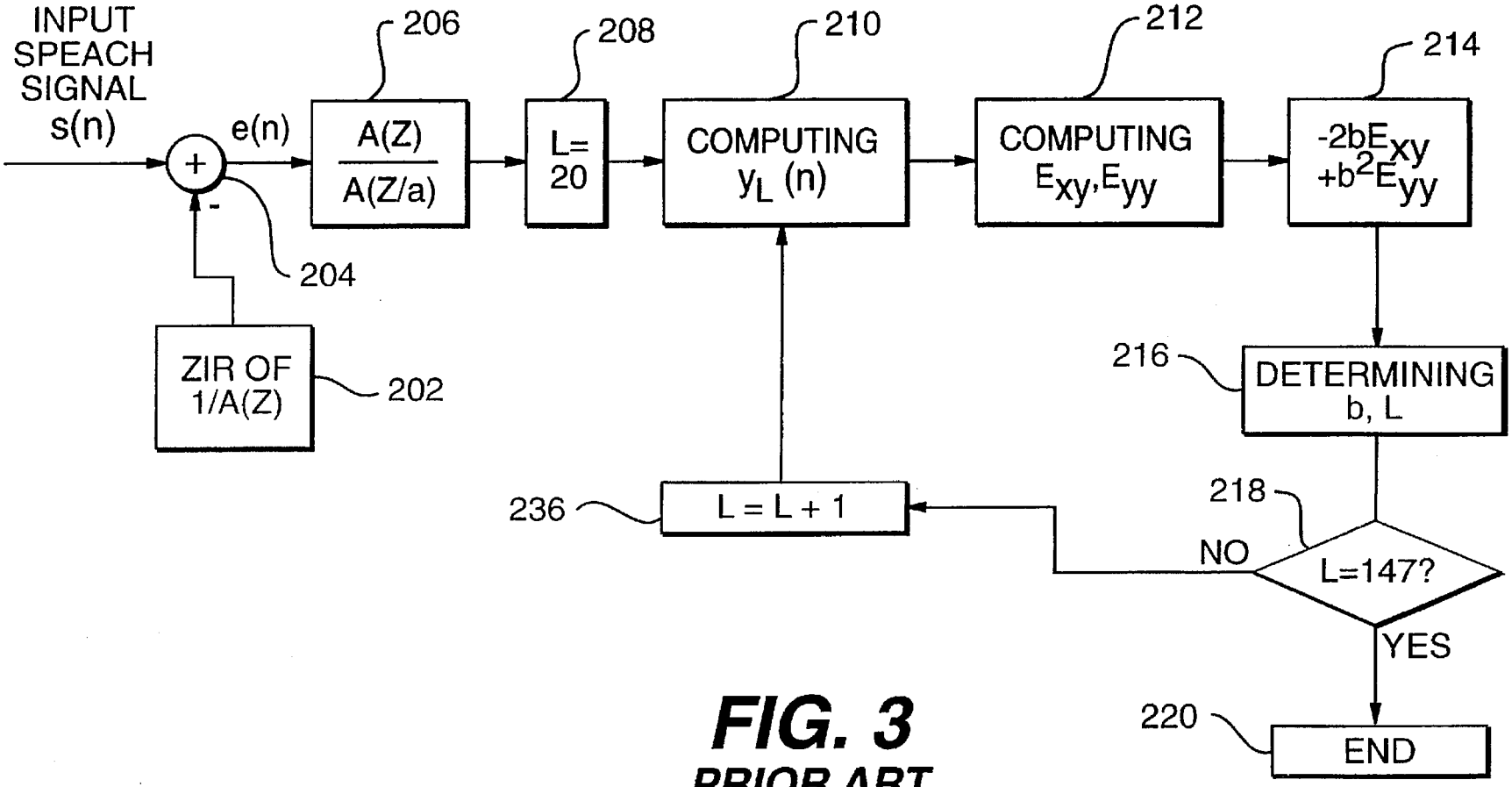
FIG. 3 PRIOR ART
FIG. 3 is a flow-chart showing the procedure of a prior art speech signal processing method.

In FIG. 2, a part 230 indicated by a dashed line is a principal part of the speech processing method which is combined with the prior art speech signal processing method of FIG. 3.

In step 232, the input speech signal s(n) is preprocessed in accordance with an autocorrelation, and therefore preliminary pitches can be obtained. In step 234, coefficients of a pitch filter are obtained from the preliminary pitches so as to search intervals having high autocorrelation values. Also the remaining interval in the pitch lag is eliminated and a variable Ks corresponding to the remaining interval is added to a lag or increment variable L in step 236, i.e. L=L+Ks.

Therefore, a high interval in the autocorrelation is searched from the preliminary pitches during the performing of the steps in a closed loop of steps 208 to 218, and the variable Ks corresponding to the remaining interval is added to the increment variable L. Thus the number of the remaining interval is subtracted from the repeated computation number (i.e., 128) of the closed loop. Accordingly by the searching method of the present invention, computation time can be sufficiently reduced.

In searching the pitch interval, the correlation value E(L) of the residual signal s(n) according to the time delay is computed as follows:

$$E(L)=\frac{\sum_{n=0}^{M-1}[s(n)\times s(n-L)]}{\sum_{n=0}^{M-1}[s(n-L)\times s(n-L)]} \tag{12}$$

where M is subframe length; and

L is the time delay of a lag variable. Whenever the time delay is conformed to the constant times of the periodicity of speech waveform, the autocorrelation has the maximum value.

The purpose of the pitch searching in the CELP vocoder is to obtain the pitch gain [b] and the pitch lag [L] so that the speech signal synthesized with the residual signal and with the pitch gain "b" and pitch lag "L" appears most like the original speech, and it is equivalent to locating the case where the correlation according to the time delay has the highest value. To obtain the time lag which has the maximum correlation, it is necessary to search the duration of pitch sequentially. Because the full pitch searching method requires too much processing time, the duration of the high correlation can initially be obtained by preprocessing. By restricting the range of the pitch search, computation time can be reduced.

The pitch in speech signals can be defined as the interval between the repetitive peaks or valleys. In the case of pitch detection by using the peaks, the autocorrelation generates higher values only about a time delay where salient peaks exist.

On the other hand, by using the valleys, the high autocorrelation can be obtained only for a time delay where a prominent valley exists. If peaks and valleys in the waveform are previously detected, the correlation can be computed according to the following equation (11)

$$R(L)=\sum_{n=-1}^{1}s(n-L)\times[s(n)+s(n-2L)]+\sum_{k=-1}^{1}s(k-L)\times[s(k)+s(k-2L)] \tag{14}$$

where L=20, 21, . . . , 147;

where s(n) the time-shifted signal with respect to the peak point "n", s(k) is the residual signals, n=0 is the vertex of a peak, and k=0 is the vertex of a valley.

In order that the correlation value is most affected by impulse noise, adjacent values of "n−1" and "n+1" and adjacent values of "K−1" and "K+1" are included with "n=0".

The method that finds a peak that comes within a pitch period that conforms to a standard defined by a distinctive peak is to make use of the property that the correlation value of equation (14) forms a maximum correlation peak every vertex of the peak.

If the correlation of the equation (14) is computed for the residual signal, the computed correlation value has a positive peak whenever peaks exist. Therefore, during the duration of the positive correlation, the peaks are considered as preliminary pitches, and a combination $\{L_1, L_2, \ldots, L_{n-1}\}$ of these is made. The detected preliminary pitch combination is applied to correlation equation (1), the pitch lag value of the pitch filter is determined by the maximum $e(L_i)$, and the coefficient of the pitch filter is as follows:

$$b_i=\frac{E_{sy}}{E_{yy}} \tag{15}$$

$$=\frac{\sum_{n=0}^{M-1}[s(n)\times s(n-L_i)]}{\sum_{n=0}^{M-1}[s(n-L_i)\times s(n-L_i)]} \tag{16}$$

where "$L_i$" is the optimum pitch lag found by the above search process.

The above described preliminary pitch detection procedure requires six multiplication, ten additions, and one comparison per time delay, but since only a few points are left to search by the preliminary operation, the pitch search time can be fairly well reduced. The number of preliminary pitches is usually related to the first formant frequency in a pitch period. Because the frequency of the first formant is between 250 Hz and 750 Hz, the maximum number of peaks in a pitch search interval is 750/(8000/147)=13.78. In the full pitch searching method, equation (10) is processed 18 times, but the computation of equation (10) in the method of the present invention can be reduced to less than 14 times by adding a simple preprocessing operation. If the number of preliminary pitches is founded to be more than 14, then the present frame can be considered to be unvoiced, mixed, or background noise. Because a pitch search has a meaning only for voiced speech, the number of preliminary pitches can be limited to 14.

As described above, since the present invention proposes a speech processing method which uses only a high interval in the autocorrelation of a voice waveform in pitch-searching in a case that is embodied in a CELP vocoder, the total computation time of the CELP vocoder can be decreased 37% or more without lowering of a speech quality.

Therefore, a digital signal processor which is low in price and slow in speed can be embodied in a CELP vocoder.

In addition, since the computation time of a CELP vocoder has a direct influence on power consumption, with the present invention less computation time means that the operating time of a portable vocoder can be extended.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art which this invention pertains.

What is claimed is:

1. A method for processing an input speech signal to be applied to a CELP vocoder, the method comprising the steps of:

obtaining preliminary pitch search intervals by means of a preprocessing autocorrelation expression from a pitch lag of a synthesized speech signal which is synthesized from a residual signal of the input speech signal; and computing coefficients of a pitch filter with respect to the preliminary pitch search intervals;

wherein the preprocessing correlation is defined by the following expression:

$$R(L)=\sum_{k=-1}^{1} s(n-L)\times[s(n)+s(n-2L)]+\sum_{k=-1}^{1} s(k-L)\times[s(k)+s(k-2L)]; \quad (10)$$

where n is a peak point, s(n) indicates the time-shifted signal with respect to the peat point n, s(k) indicates the time-shifted signal with respect to the valley point, n=0 is the vertex of a peak, and k=0 is the vertex of a valley, and where L=20, 21, . . . 147.

2. The method as defined in claim 1, wherein the coefficient of the pitch filter, $b_i$, is defined as follows:

$$b_i=E_{sy}/E_{yy}=\frac{\sum_{n=0}^{M-1}[s(n)\times s(n-L_i)]}{\sum_{n=0}^{M-1}[s(n-L_i)\times s(n-L_i)]}$$

where $L_i$ is the optimum pitch lag found by the search process of claim 1.

* * * * *